US007974433B2

(12) United States Patent
Andersen et al.

(10) Patent No.: US 7,974,433 B2
(45) Date of Patent: Jul. 5, 2011

(54) INSERT MOLDED SURROUND WITH MECHANICAL SUPPORT

(75) Inventors: Morten Kjeldsen Andersen, Odder (DK); Leif Johannsen, Odder (DK)

(73) Assignee: Gettop Europe R&D ApS, Herlev (DK)

( * ) Notice: Subject to any disclaimer, the term of this patent is extended or adjusted under 35 U.S.C. 154(b) by 1127 days.

(21) Appl. No.: 11/525,002

(22) Filed: Sep. 21, 2006

(65) Prior Publication Data

US 2007/0081693 A1 Apr. 12, 2007

Related U.S. Application Data

(60) Provisional application No. 60/719,104, filed on Sep. 21, 2005.

(51) Int. Cl.
*H04R 25/00* (2006.01)

(52) U.S. Cl. ..... 381/398; 381/396; 381/423

(58) Field of Classification Search ..... 381/396, 381/398, 399, 404, 423–424, 152
See application file for complete search history.

(56) References Cited

U.S. PATENT DOCUMENTS

| | | | | |
|---|---|---|---|---|
| 3,684,052 | A | 8/1972 | Sotome | |
| 4,239,944 | A * | 12/1980 | Obara et al. | 381/404 |
| 5,455,396 | A | 10/1995 | Willard et al. | 181/172 |
| 5,574,797 | A | 11/1996 | Geisenberger | 381/193 |
| 5,608,810 | A | 3/1997 | Hall | |
| 5,850,462 | A * | 12/1998 | Sakamoto et al. | 381/404 |
| 6,039,145 | A | 3/2000 | Ogura et al. | |
| 6,052,473 | A | 4/2000 | Clavadetscher et al. | 381/322 |
| 6,183,674 | B1 | 2/2001 | Nonogaki | 264/46.4 |
| 6,269,167 | B1 * | 7/2001 | Mango et al. | 381/404 |
| 6,332,262 | B1 | 12/2001 | Sakamoto | |
| 6,853,734 | B2 * | 2/2005 | Sahyoun | 381/404 |
| 6,940,991 | B2 * | 9/2005 | Shingu | 381/404 |

FOREIGN PATENT DOCUMENTS

| | | | |
|---|---|---|---|
| EP | 0552040 | A1 | 7/1993 |
| FR | 2561848 | A1 | 9/1985 |
| GB | 2326373 | A | 12/1998 |
| WO | 03063545 | A1 | 7/2003 |

OTHER PUBLICATIONS

Extended European Search Report Application Serial No. 06019749.8, European Patent Office; dated May 6, 2010; (10 pages).

* cited by examiner

*Primary Examiner* — Suhan Ni
(74) *Attorney, Agent, or Firm* — Nixon Peabody LLP

(57) ABSTRACT

A suspension member for a diaphragm, the suspension member comprising an inner portion being adapted to be attached to a substantially stiff piston part, a outer portion arranged on or integrated with a substantially stiff support member so as to mechanically stabilize the suspension member, and a flexible member connecting the inner and outer portions. The present invention further relates to an electro-acoustic transducer, preferably a miniature electro-acoustic transducer, applying such suspension member.

15 Claims, 7 Drawing Sheets

INSERT MOLDED SURROUND WITH MECHANICAL SUPPORT

CROSS-REFERENCE TO RELATED APPLICATION

This application claims the benefit of U.S. Provisional Application Ser. No. 60/719,104, entitled "Insert Molded Surround With Mechanical Support," filed Sep. 21, 2005.

FIELD OF THE INVENTION

The present invention relates to a moulded surround with a mechanical support. In particular, the present invention relates to moulded surround of silicone, rubber or any other soft material having a mechanical support attached thereto in order to ease handling of the surround.

BACKGROUND OF THE INVENTION

Diaphragms for electro-acoustic transducer typically comprise a substantially stiff piston part and a flexible surround. The piston and flexible surround may be manufactured as a one piece component or they may be manufactured separately. In the latter situation the piston and the surround may be manufactured using different materials. For example, it may be advantageous to manufacture the piston in a stiffer material compared to the material used for manufacturing the surround. Thus, by manufacturing the piston and the surround in different materials the acoustical properties of the diaphragm can be custom designed for specific purposes.

When the piston and surround are manufactured separately one has to handle the surround at least during the assembling process of the surround and the piston. However, due to its softness and flexibility the surround is rather difficult if not impossible to handle in an effective manner.

Thus, there is a need for ensuring effective and secure handling of flexible surrounds for diaphragms.

Based of the above, it may be seen as an object of the present invention to provide a suspension member, also called a surround, which is easy to handle without exposing the surround itself to unnecessary risks.

SUMMARY OF THE INVENTION

The above-mentioned object is complied with by providing, in a first aspect, an electro-acoustic transducer comprising:

a displaceable diaphragm comprising a suspension member and a piston, wherein the suspension member comprises;

an inner portion being adapted to support the piston;

an outer portion arranged on or integrated with a substantially stiff support member so as to mechanically stabilise the suspension member, the support member being secured to a substantially stationary portion of the electro-acoustic transducer;

a flexible member connecting the inner and outer portions; and an electro-mechanical motor adapted to generate an electrical output signal in response to displacements of the diaphragm, or to displace the diaphragm in response to an electrical input signal.

The electro-mechanical motor may be operated in two modes of operation. In a first mode of operation the electro-mechanical motor may be adapted to generate an electrical output signal in response to displacements of the diaphragm due to pressure variations, such as audible sound pressures, in the environment surrounding the electro-acoustic transducer. In this first mode of operation the electro-acoustic transducer is operated as a microphone, preferably a miniature microphone. In another mode of operation the electro-mechanical motor is adapted to receive an incoming electrical signal and, in response to this, generate an audible acoustical signal by displacing the diaphragm in response to the electrical input signal. In this second mode of operation the electro-acoustic transducer is operated as a speaker, preferably a miniature speaker.

The electro-mechanical motor may in general be implemented as a moving coil arrangement or a moving magnet arrangement. In the moving coil arrangement the electro-mechanical motor may comprise a magnetic circuit adapted to generate a magnetic flux in an air gap. In addition an electrically conducting voice coil comprising first and second end portions may be provided. The voice coil may be operatively connected to the diaphragm and, at least partly, positioned in the air gap. The first and second end portions of the voice coil are preferably electrically connected to first and second electrically conducting elements, respectively. These first and second electrically conducting elements may be adapted to transport electrical signals across the suspension member. The first and second electrically conducting elements may be at least partly embedded into the flexible member.

In a moving magnet arrangement, the electro-mechanical motor may comprise means for generating a magnetic field in response to an electrical input signal. In addition, a mechanical drive member operatively connected to the diaphragm may be provided, said mechanical drive member being movable in response to the electrical input signal. Thus, in response to the electrical input signal the mechanical drive member causes a displacement of the diaphragm. This type of motor is often referred to as a moving armature arrangement.

The inner portion of the suspension member may comprise an inner edge attached to an associated outer edge of the piston. Thus, according to this embodiment the inner edge of the suspension member forms a through-going opening prior to the piston being attached to the suspension member. Alternatively, the inner portion of the suspension member may comprise a supporting surface attached to an associated surface portion of the piston. The supporting surface of the suspension member may comprise an essentially plane surface portion. According to this embodiment the suspension member comprises a supporting surface to which the piston may be glued, welded or by other means attached.

The flexible member may comprise a material selected from the group consisting of: silicone, rubber or any combination thereof.

In a second aspect, the present invention relates to suspension member for a diaphragm, the suspension member comprising:

an inner portion being adapted to support a piston;

an outer portion arranged on or integrated with a substantially stiff support member so as to mechanically stabilise the suspension member, and a flexible member connecting the inner and outer portions.

It is an advantage of the present invention that the assembly process of an electro-acoustic transducer becomes significantly easier, because the support member can be used to handle and centre the surround for further processing. The support member can either form an integrated part of the assembly, or it can be a "dummy" support, which will be cut away shortly after the mounting of the surround to a piston part and/or the mounting of the finalized diaphragm to a basket of an electro-acoustic transducer.

In case the mechanical support member is integrated with the outer portion of the of the suspension member the outer portion and the support member may be fabricated from the same material, and fabricated in the same manufacturing process, such as an injection moulding process. In case the support member is of a different material than the outer portion of the surround, the support member may be fabricated separately and attached to the outer portion of the surround at an appropriate stage in the production process. The attaching of the outer portion of the suspension member to the support member may be provided using gluing, welding, heating or other suitable techniques.

The flexible member may comprise at least one electrically conducting element adapted to transport electrical signals across the suspension member, for example, signals between one or more circuits arranged on the outer portion side of the suspension member and one or more circuits arranged on the piston. Such circuits may be circuits, such as ASICs, for signal processing, a circuit to be at least partly positioned and operated in an air gap in an associated magnetic circuit, etc. The signals to be transported across the surround may be power supply signals, data signal signals, synchronising signals, etc.

The at least one electrically conducting element may be at least partly embedded into the flexible member having a first free end accessible at the inner portion and a second free end accessible at the outer portion. Preferably, the at least one electrically conducting element has the form of a thin electrically conducting wire that is fully, except for the first and second free ends, embedded into the surround. The number of wires embedded into the surround can be adjusted depending on the specific application of the diaphragm. Thus, the number of wires may in principle be chosen arbitrarily and the surround may thus comprise 1, 2, 4, 6, 10 or even a higher number of wires embedded into the surround.

The inner portion of the suspension member may comprise an inner edge adapted to be attached to an associated outer edge of the piston. Thus, according to this embodiment the inner edge of the suspension member forms a through-going opening prior to the piston being attached to the suspension member. Alternatively, the inner portion of the suspension member may comprise a supporting surface adapted to be attached to an associated surface portion of the piston. The supporting surface of the suspension member may comprise an essentially plane surface portion. According to this embodiment the suspension member comprises a supporting surface to which the piston may be glued, welded or by other means attached.

The surround itself may comprise a material selected from the group consisting of: silicone, rubber or any combination thereof. However, any soft material with the appropriate mechanical properties may in principle be used. The suspension member may take a substantially circular shape, a substantially oval shape or a rectangular shape. However, other shapes may also be applicable.

As already mentioned, the substantially stiff support member may form an integral part of the suspension member whereby the outer portion and the support member are fabricated from the same material. Also, the outer portion and the support member are most likely fabricated in the same manufacturing process, such as in an injection moulding process.

In a third aspect, the present invention relates to a diaphragm for an electro-acoustic transducer, the diaphragm comprising a suspension member according to the second aspect of the present invention, and a piston secured to the inner portion of the suspension member.

Thus, in the present content a diaphragm may be defined as an essentially stiff piston portion and a flexible surround surrounding and suspending the piston portion. The piston may comprise a material selected from a group consisting of: a polyimide, aluminium, polymer, such as nylon, or other materials having similar mechanical properties in terms of Young's modulus. Alternatively, the piston may comprise a flex print, optionally with coils integrated therein.

In a fourth aspect, the present invention relates to a portable communication device comprising at least one electro-acoustic transducer according to the first aspect of the present invention, said portable communication device being selected from the group consisting of: cellular phones, PDAs (personal digital assistants), game consoles, In the Ear Monitors (IEMs), hearing prosthesis's, and portable computers.

In a fifth aspect, the present invention relates to a method for manufacturing a suspension member, the method comprising the steps of:

providing an insert moulds, said insert mould being shaped so that a suspension member may be injection moulded in said insert mould, providing an injection mouldable material into the insert mould, and stabilising an injection moulded suspension member by providing a substantially stiff support member to an outer portion of the injection moulded suspension member.

The substantially stiff support member may be provided as part of injection moulding the suspension member so as to provide a support member forming an integral part of the suspension member. The injection mouldable material may be selected from the group consisting of: silicone, rubber, or any combination thereof.

The above summary of the present invention is not intended to represent each embodiment, or every aspect, of the present invention. Additional features and benefits of the present invention are apparent from the detailed description, figures, and claims set forth below.

BRIEF DESCRIPTION OF THE INVENTION

The present invention will now be explained in further details with reference to the accompanying figures, wherein.

Figure 1:
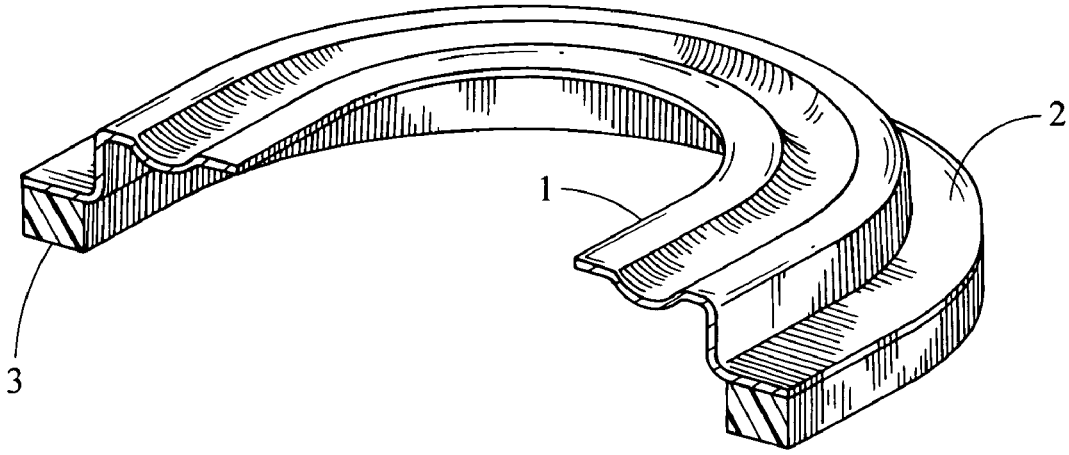
FIG. 1 shows a first embodiment of the present invention.

While the invention is susceptible to various modifications and alternative forms, specific embodiments have been shown by way of example in the drawings and will be described in detail herein. It should be understood, however, that the invention is not intended to be limited to the particular forms disclosed. Rather, the invention is to cover all modifications, equivalents, and alternatives falling within the spirit and scope of the invention as defined by the appended claims.

DETAILED DESCRIPTION OF THE INVENTION

In its most general aspect the present invention relates to a moulded surround with a build-in mechanical support for simplifying the handling of the surround.

FIG. 1 shows a first embodiment of the present invention in its most simple form. As seen, FIG. 1 shows a surround having an inner edge 1 and an outer portion 2. The inner edge 1 is adapted for being attached to a piston part (not shown) whereas the outer portion 2 is attached to a support structure 3 for mechanically supporting the surround thereby obtaining an easier handling of the surround. The support structure 3 can be a separate structure which is glued, heated, welded or by other means attached to the outer portion 2. Alternatively, the support structure 3 can form an integral part of the surround in that the support structure 3 can be injection moulded in the same process as the injection moulding of the surround.

Figure 2A:
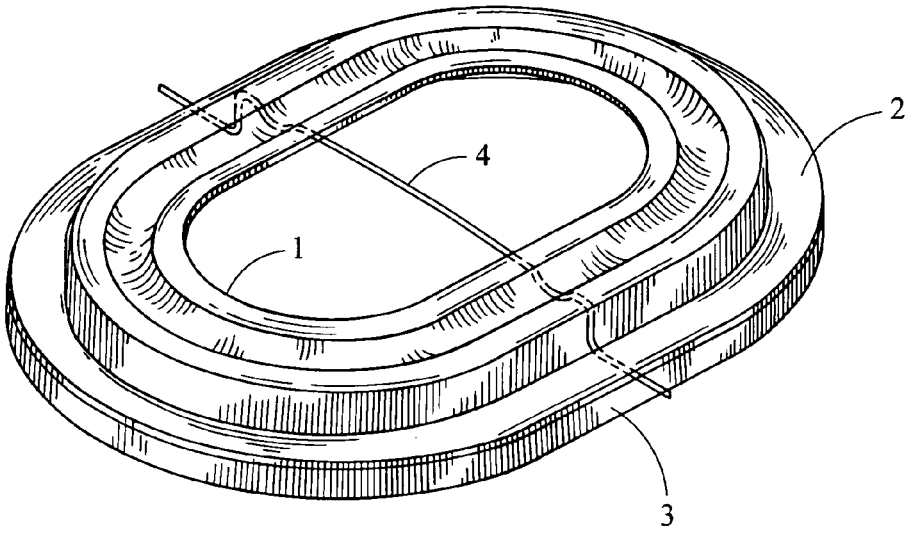
FIG. 2 shows first embodiments of the present invention with an integrated lead-out wire.
Figure 2B:
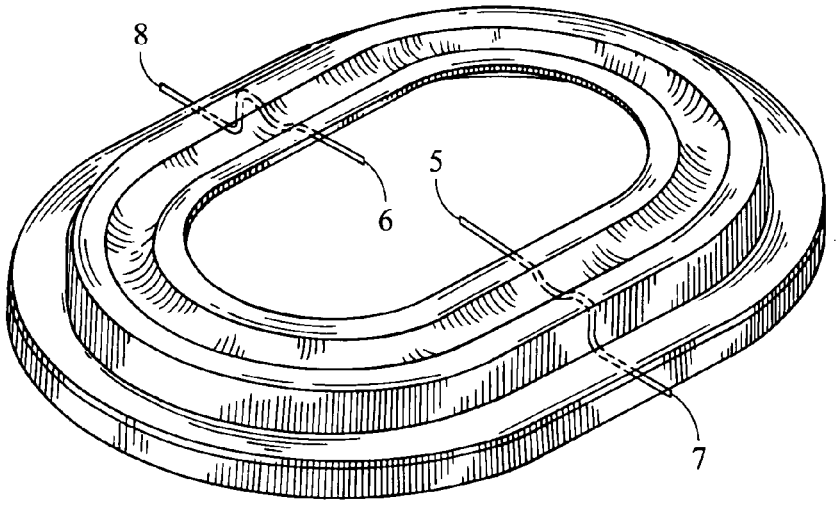

In FIG. 2*a*, a through-going integrated lead-out wire 4 is depicted. In FIG. 2*b*, this through-going lead-out wire has been divided into two lead-out wires. Each of these lead-out wires has an inner end 5, 6 and an outer end 7, 8. The inner ends 5, 6 are adapted to be electrically connected to electrical elements/circuits arranged on a piston attached to the inner edge 1. Such electrical elements/circuits can be wounded coils, such as voice coils, ASICs or other kinds of electronic circuits or components. Also, the number of lead-out wires can differ from the two lead-out wires depicted in FIG. 2*b*. Thus, in case an ASIC is arranged on the piston lead-out wires for power supply, clock signals, data signals, etc. may be provided in order to transport electrical signals across the moulded surround.

The moulded surround itself is made of a soft material, such as silicone, rubber or a similar soft material. The material constituting the surround can be chosen independently of the piston material. The piston to be attached to the surround is typically made of a stiffer material, such as Kapton® polyimide material, aluminium, nylon, flex print, etc.

Figure 3A:
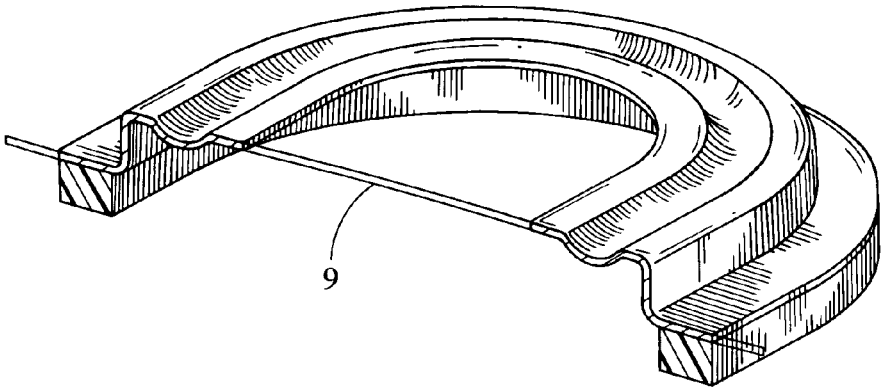
FIG. 3 shows a cross-sectional view of the first embodiment of the present invention.
Figure 3B:
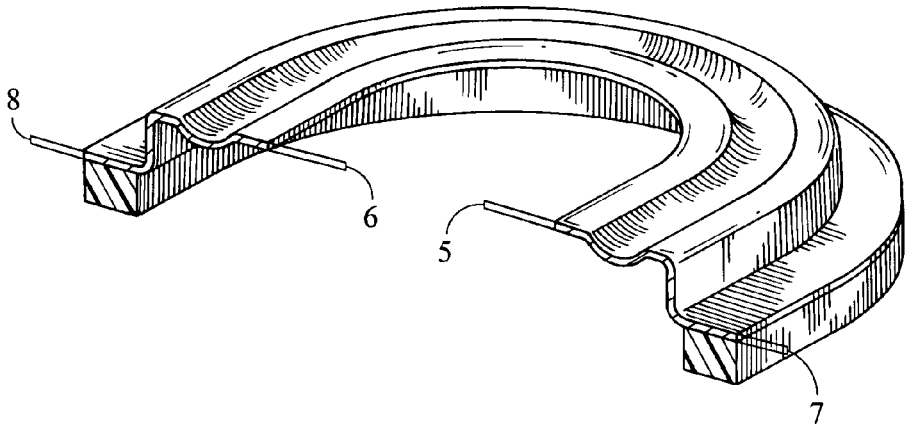

Referring now to FIG. 3*a*, a moulded surround including mechanical support and a through-going lead-out wire 9 is depicted. This through-going lead-out wire 9 is a result of an advantageous fabrication technique where a series of injection moulds are positioned next to each other and where a single wire is positioned across all moulds. By applying this fabrication technique, a series of moulded surrounds with a through-going integrated lead-out wire or lead-out wires can be manufactured. Naturally, the through-going lead-out wire 9 shown in FIG. 3*a* needs to be cut so that the free wire ends can be connected to, for example, a set of moving coils. The free wire ends are shown in FIG. 3*b*—the inner wire ends are denoted 5, 6, whereas the outer wire ends are denoted 7, 8.

Figure 4:
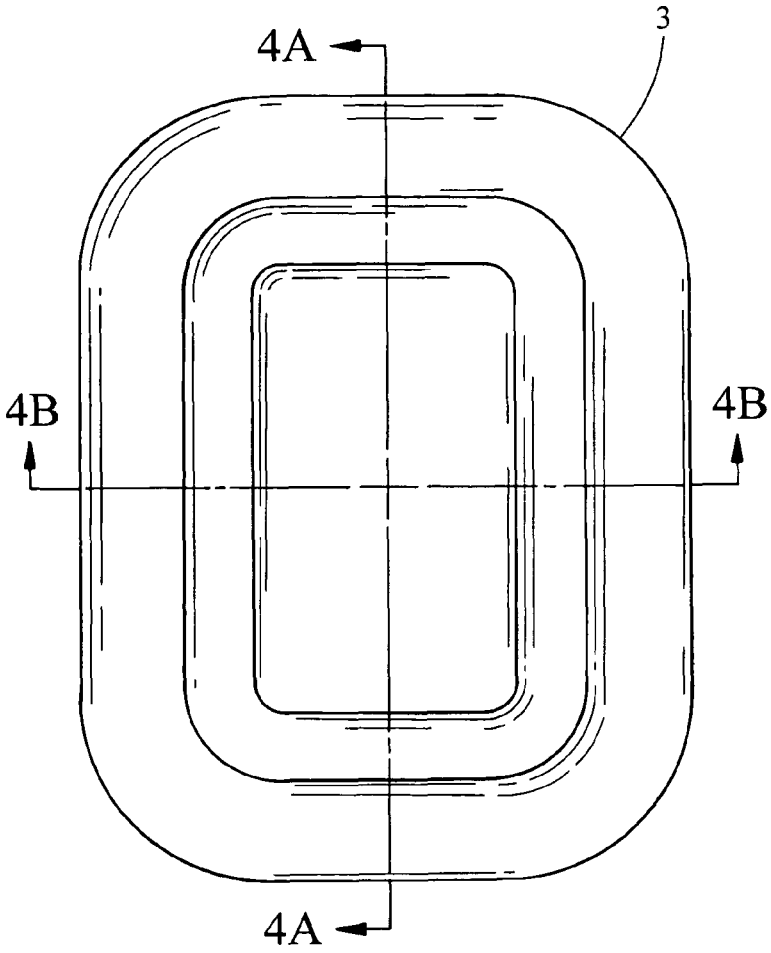
FIG. 4 shows cross-sectionals views of a second embodiment of the present invention.
Figure 4A:
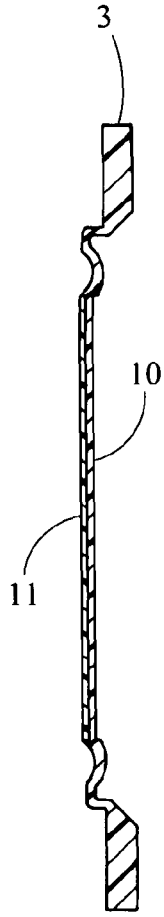
Figure 4B:
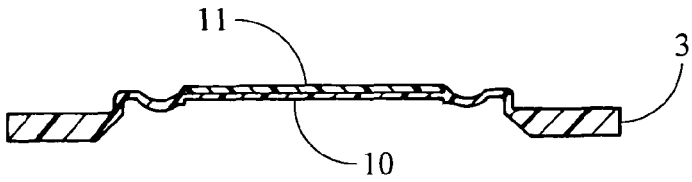

FIG. 4 shows cross-sectional views of an alternative embodiment of the present invention. In this embodiment a supporting surface 10 is moulded together with the surround. Thus, the supporting surface 10 is moulded in the same process by which the surround itself is moulded. The supporting surface 10 forms a support for mounting a piston 11 so that a better support for this piston is achieved. The piston can be attached to the support 10 (or to the inner edge 1 of FIG. 1) by means such as, for example, gluing, heating or ultrasound-based welding. The mechanical support 3 is also depicted in FIG. 4.

Figure 5:
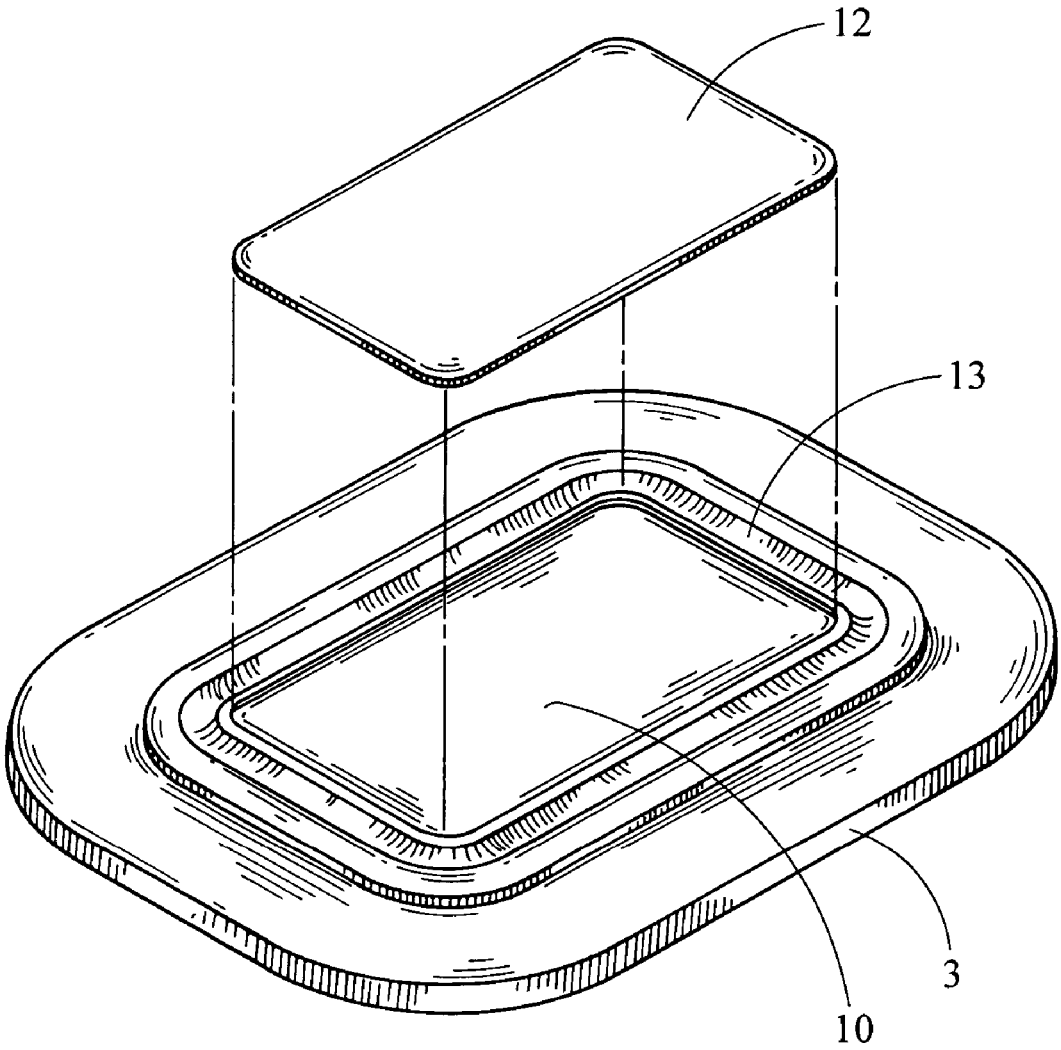
FIG. 5 shows a cross-sectional view of the second embodiment of the present invention.
Figure 6:
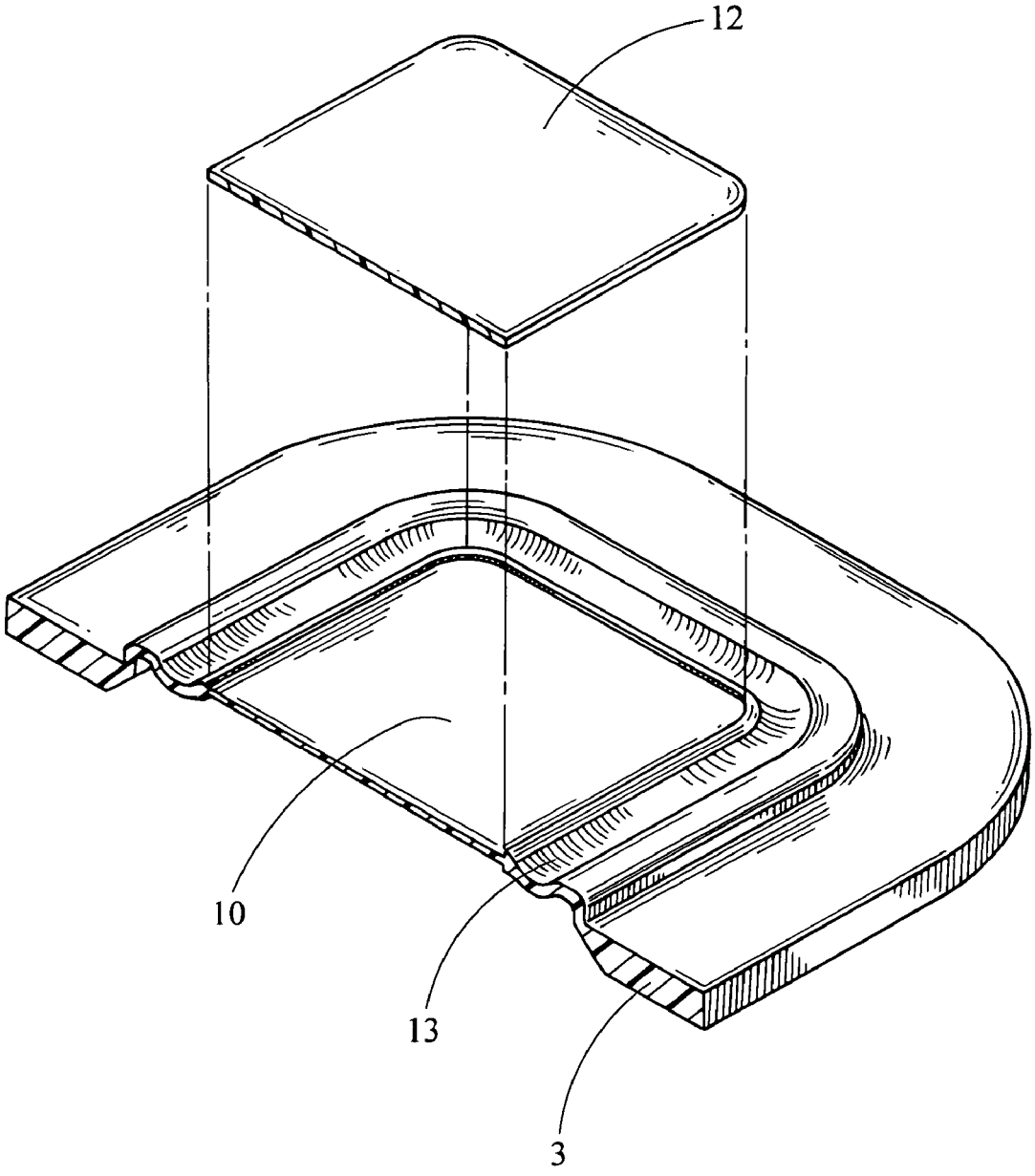
FIG. 6 shows a cross-sectional view of the second embodiment of the present invention.

FIGS. 5 and 6 show how the piston 12 is mounted on the supporting surface 10 of the surround 13. The support member 3 is also depicted in FIGS. 5 and 6. Again, the piston can be attached to the surround by means such as, for example, gluing, heating or ultrasound-based welding.

Figure 7:
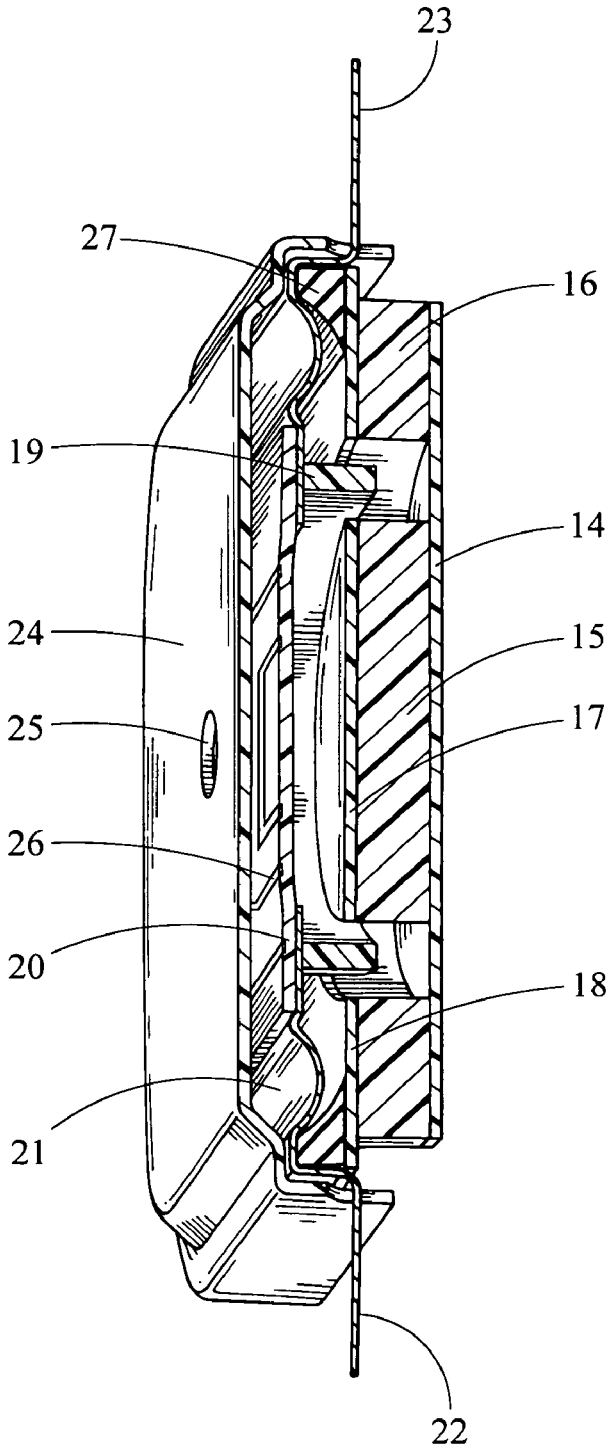
FIG. 7 shows a cross-sectional view of an electro-acoustic transducer according to the present invention.

FIG. 7 shows a cross-sectional view of an electro-acoustic transducer according to the present invention. As depicted in FIG. 7 the electro-acoustic transducer comprises a motor comprising a yoke 14, a centre magnet 15, an annular magnet 16, a centre pole piece 17, an outer pole piece 18 and a voice coil 19 positioned in an air gap between the centre pole piece 17 and the outer pole piece 18. The voice coil 19 is attached to the piston 20, the latter forming part of a displaceable diaphragm also comprising the surround 21 having at least two integrated lead-out wires 22, 23 integrated therein. The surround 21 is attached to a mechanical support member 27 which provides the necessary distance to the outer pole piece 18. A cover 24 having one or more acoustical outlets 25 arranged therein protects the diaphragm. The piston 20 of the diaphragm depicted in FIG. 7 carries an electronic device 26 in form of the coil arranged on the upper surface of the piston 20. This coil may be adapted for establishing a coupling to a T-coil of an external hearing aid. As already mentioned the lead-outs 22, 23 are adapted to allow electrical signals to be transported across the surround 21 to the planar coil 26 and the voice coil 19. In case for example an ASIC is arranged on the piston 20 as well additional lead-outs are required in order to transport signals to and from said ASIC.

The moulded surrounds depicted in FIGS. 1-7 are all oval or rectangular in shape. However, the moulded surround may in principle take any shape such as circular, elliptical, quadratic or any other shape.

The invention claimed is:

1. A miniature suspension member for a diaphragm, the suspension member comprising:

an inner portion being adapted to be attached to a piston having a substantially flat major surface, the inner portion defining a closed area on which the piston is adapted to be attached;

an outer portion arranged on or integrated with a substantially stiff support member so as to mechanically stabilise the suspension member; and a flexible member connecting the inner and outer portions, wherein the inner portion, the flexible member, and the outer portion form a single integrated piece.

2. A suspension member according to claim 1, wherein the flexible member comprises at least one electrically conducting element adapted to transport electrical signals across the suspension member.

3. A suspension member according to claim 2, wherein the at least one electrically conducting element is at least partly embedded into the flexible member.

4. A suspension member according to claim 2, wherein the at least one electrically conducting element has a first free end accessible at the inner portion of the suspension member, and a second free end accessible at the outer portion of the suspension member.

5. A suspension member according to claim 1, wherein the inner portion comprises an inner edge, said inner edge being adapted to be attached to an associated outer edge of the piston.

6. A suspension member according to claim 1, wherein the inner portion comprises a supporting surface, said supporting surface being adapted to be attached to an associated surface portion of the piston.

7. A suspension member according to claim 6, wherein the supporting surface comprises an essentially plane surface portion.

8. A suspension member according to claim 1, comprising 2, 4 or 6 electrically conducting elements.

9. A suspension member according to claim 1, wherein the flexible member comprises a material selected from the group consisting of: silicone and rubber.

10. A suspension member according to claim 1, wherein the suspension member takes a substantially circular, a substantially oval or a substantially rectangular shape.

11. A suspension member according to claim 1, wherein the substantially stiff support member forms an integral part of the suspension member.

12. A miniature diaphragm for an electro-acoustic transducer, the diaphragm comprising:

a suspension member comprising:

an inner portion being attached to a piston having a substantially flat major surface, the inner portion defining a closed area on which the piston is adapted to be attached, an outer portion arranged on or integrated with a substantially stiff support member so as to mechanically stabilise the suspension member, and a flexible member connecting the inner and outer portions, wherein the inner portion, the flexible member, and the outer portion form a single integrated piece.

13. A diaphragm according to claim 12, wherein the piston comprises a polyimide, aluminium, polymer, or nylon.

14. A diaphragm according to claim 12, wherein the piston comprises a flex print.

15. The suspension member according to claim 1, wherein a first plane lying across the outer portion is distinct from and parallel to a second plane lying across the inner portion when the piston is stationary.

* * * * *